US006476546B1

(12) United States Patent
Bae

(10) Patent No.: US 6,476,546 B1
(45) Date of Patent: Nov. 5, 2002

(54) ELECTRON GUN FOR COLOR CATHODE RAY TUBE HAVING DIFFERENT MATERIALS FOR DIFFERENT ELECTRODES

(75) Inventor: Min-cheol Bae, Suwon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/490,282

(22) Filed: Jan. 24, 2000

(30) Foreign Application Priority Data

Jan. 25, 1999 (KR) ..... 99-2169

(51) Int. Cl.[7] ..... H01J 29/48; H01J 29/51
(52) U.S. Cl. ..... 313/447; 313/446; 313/412
(58) Field of Search ..... 313/412, 413, 313/414, 428, 446, 447, 452, 441, 449, 458; 445/3

(56) References Cited

U.S. PATENT DOCUMENTS 4,952,186 A 8/1990 Maninger et al.
5,010,271 A * 4/1991 Maninger et al. ..... 313/412
5,081,393 A * 1/1992 Kinami ..... 313/412
5,944,571 A * 8/1999 van Raalte et al. ..... 445/3

FOREIGN PATENT DOCUMENTS

JP 2-82432 * 3/1990 ..... H01J/29/50

* cited by examiner

*Primary Examiner*—Nimeshkumar D. Patel
*Assistant Examiner*—Karabi Guharay
(74) *Attorney, Agent, or Firm*—Lowe Hauptman Gilman & Berner, LLP

(57) ABSTRACT

An electron gun for a color cathode ray tube includes a cathode, control electrode and a screen electrode forming a triode, and first and second focus electrodes forming an electron lens, wherein the thermal expansion coefficient of said screen electrode is less than the thermal expansion coefficient of said control electrode.

3 Claims, 7 Drawing Sheets

ELECTRON GUN FOR COLOR CATHODE RAY TUBE HAVING DIFFERENT MATERIALS FOR DIFFERENT ELECTRODES

BACKGROUND OF THE INVENTION

1. Field of the Invention

The present invention relates to an electron gun for a color cathode ray tube having an improved electrode to improve convergence drift of an electron gun.

2. Description of the Related Art

In general, an electron gun, installed at a neck portion of a funnel of a cathode ray tube, emits thermions which excite a phosphor film. The electron gun includes a cathode, a control electrode and a screen electrode forming a triode, and first and second focus electrodes and a final acceleration electrode forming an auxiliary lens and a main lens, respectively. The center of an electron beam passing hole formed at both sides of an output surface of the second focus electrode is offset from the center of an electron beam passing hole at both sides of the final acceleration electrode so that three electron beams converge on a phosphor point.

A predetermined voltage is applied to the electrodes of the electron gun. For instance, an electrostatic focus voltage can be applied to the first focus electrode and a dynamic focus voltage, synchronized with an output signal of a deflection yoke and having the electrostatic focus voltage as a base voltage, can be applied to the second focus electrode.

In the operation of the electron gun for the conventional cathode ray tube having the above structure, when a predetermined voltage is applied to each of the electrodes, an electron lens is formed between each electrode and the thermions, emitted by the cathode and then accelerated, are focused by the electron lenses and land on the phosphor film. Thus, phosphor of the phosphor film is excited so that an image is formed.

Here, when the electron beam is deflected toward the periphery of the phosphor film, as a dynamic focus voltage synchronized with a deflection signal is applied to the second focus electrode, the intensity of the main lens between the second focus lens and the final acceleration electrode is lowered so that convergence of the electron beams located at both sides is not made accurately. As the electrodes of the electron gun are thermally expanded due to the heat generated from the cathode and the deflection yoke, displacement of the electron beam passing holes is made so that a phenomenon of drift of the electron beam is generated.

The drift phenomenon causes inaccurate landing of the electron beam on a phosphor point, thus causing color blurring of an image and lowering the resolution thereof.

To solve the above problems, a conventional electron gun is suggested in U.S. Pat. No. 4,952,186. A method of manufacturing a color cathode ray tube for reduction of convergence drift is disclosed in the patent, in which at least an electrode of the first group electrodes for generating electron beam misconvergence in the first direction is made of material exhibiting a thermal expansion coefficient lower than that of the other electrodes.

However, in the above method, misconvergence due to thermal expansion between the electrodes is not sufficiently corrected.

SUMMARY OF THE INVENTION

To solve the above problems, it is an objective of the present invention to provide an electron gun for a color cathode ray tube which can improve the property of convergence by reducing the amount of drift of an electron beam according to thermal expansion of the electrode.

Accordingly, to achieve the above objective, there is provided an electron gun for a color cathode ray tube which comprises a cathode, control electrode and a screen electrode forming a triode, and first and second focus electrodes forming an electron lens, wherein the thermal expansion coefficient of said screen electrode is less than the thermal expansion coefficient of said control electrode.

According to another preferred embodiment of the present invention, there is provided an electron gun for a color cathode ray tube which comprises a cathode, control electrode and a screen electrode forming a triode, and first and second focus electrodes forming an electron lens, wherein the thermal expansion coefficient of said second focus electrode is equal to or less than the thermal expansion coefficient of said control electrode and simultaneously equal to or greater than the thermal expansion coefficient of said screen electrode.

According to another preferred embodiment of th resent invention, there is provided an electron gun for a color cathode ray tube which comprises a cathode, control electrode and a screen electrode forming a triode, and first and second focus electrodes forming an electron lens, wherein the thermal expansion coefficient of said screen electrode is equal to or greater than the thermal expansion coefficient of said control electrode and simultaneously greater than the thermal expansion coefficient of said second focus electrode.

According to still yet another preferred embodiment of the present invention, there is provided an electron gun for a color cathode ray tube which comprises a cathode, control electrode and a screen electrode forming a triode, and first and second focus electrodes forming an electron lens, wherein the thermal expansion coefficient of said second focus electrode is equal to that of said control electrode and simultaneously greater than the thermal expansion coefficient of said screen electrode.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
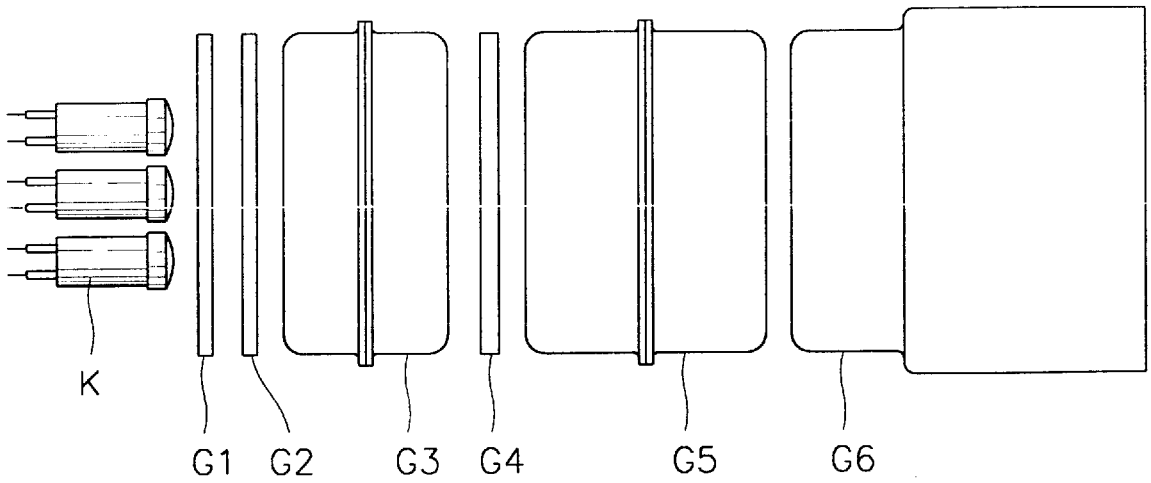
FIG. 1 is a plan view showing the structure of an electron gun according to the present invention.

Referring to FIG. 1, an electron gun for a cathode ray tube according to the present invention includes a cathode k, a control electrode G1 and a screen electrode G2 forming triodes, first and second focus electrodes G3 and G4 forming an electron lens for focusing and accelerating an electron beam, and a final acceleration electrode G6 installed to be adjacent to a third focus electrode G5 for forming a main electron lens.

The number of focus electrodes of the electron gun is not limited to the first and second focus electrodes, but may be increased for connection of the electron beam in multi-steps.

Three electron beam passing holes (not shown), through which an electron beam (hereinafter, referred to as R, G and B electron beams) for exciting phosphor of red, green and blue colors, are formed to be in-line at the respective electrodes. The electron beam passing holes are variable according to the size of electron lens formed between the electrodes and a single large-diameter electron beam passing hole through which all three electron beams pass can be formed.

For the hour or so of warm-up after a cathode ray tube starts to operate, each electrode of the electron gun experiences gradual thermal expansion because of heat generated from the cathodes. Because the extent of thermal expansion vary among the constituent electrodes for the period the electron beam passing hole happen to be misaligned causing what is known as convergence drift of the side electron beams, i.e., the side electron beam spots on the phosphor screen initially shift from their intended position before they gradually converge to the position as time goes go. According to present invention the electrodes are made of materials having different thermal expansion coefficients such that during the warm-up the side electron beams are converged to a point faster than otherwise.

In particular, the thermal expansion coefficient C2 of the material forming the screen electrode G2 is less than the thermal expansion coefficient C1 of the material forming the control electrode G1 (C1>C2). The screen electrode G2 is made of nickel alloy and the control electrode G1 is made of stainless steel. Also, the thermal expansion coefficient C4 of the second focus electrode G4 is equal to or greater than the thermal expansion coefficient C2 of the screen electrode G2 and less than the thermal expansion coefficient C1 of the control electrode G1 (C1>C4≧C2).

According to another preferred embodiment of the present invention, the thermal expansion coefficient C4 of the second focus electrode G4 is equal to the thermal expansion coefficient C1 of the control electrode G1 and greater than the thermal expansion coefficient C2 of the screen electrode G2 (C1=C4>C2).

Also, according to yet another preferred embodiment of the present invention, the thermal expansion coefficient C2 of the screen electrode G2 is equal to or less than the thermal expansion coefficient C1 of the control electrode G1 and may be greater than that C4 of the second focus electrode G4 (C1≧C2>C4).

Also, according till yet another preferred embodiment of the present invention, the thermal expansion coefficient C4 of the second focus electrode G4 is equal to the thermal expansion coefficient C1 of the control electrode G1 and may be less than the thermal expansion coefficient C2 of the screen electrode G2 (C1=C4<C2).

In the operation of the electron gun for a color cathode ray tube having the above structure, various voltages are applied to the respective electrodes according to the state of formation of the electron lens for focusing and accelerating an electron beam. For example, different constant-voltages are applied to the control electrode G1 and the screen electrode G2; a focus voltage higher than the constant-voltage can be applied to the first and second focus electrodes G3 and G4; and an anode voltage equal to a voltage applied to an inner conductive film (not shown) of the cathode ray tube can be applied to the final acceleration electrode G6.

When a predetermined electric potential is applied to the electrodes, an electron lens is formed between the electrodes and an electron emitting material is heated by a heater (not shown) in the cathode k so that thermions are emitted from the cathode. The emitted electron beam passes through the electron lens and is focused and accelerated to land on the phosphor film so that the phosphor material is excited.

In doing so, the control electrode G1, the screen electrode G2 and the first and second focus electrodes G3 and G4 are heated by the heater, the electron beam and a deflection yoke (not shown) for deflecting the electron beam and then thermally expanded. Such thermal expansion continues for about an hour until a thermally balanced state is achieved between the electrodes after the cathode ray tube is operated.

As the position of the electron beam passing hole changes according to the thermal expansion of electrodes, a drift phenomenon occurs to the electron beam passing the electron lens formed by the electron beam passing holes. Drift of the electron beam occurs in two directions. However, because the control electrode G1, made of stainless steel for example, has a higher thermal expansion coefficient C1 than that of the screen electrode G2, made of nickel alloy for example, the convergence drift of the side electron beams becomes smaller more rapidly, as more specifically illustrated in FIGS. 2 through 7.

FIGS. 2 through 7 show the results of measurement of the electron beam drift with respect to the electron gun adopting the control electrode G1, the screen electrode G2 and the second focus electrode G4 formed of materials exhibiting different thermal expansion coefficients according to the present invention.

Figure 2:
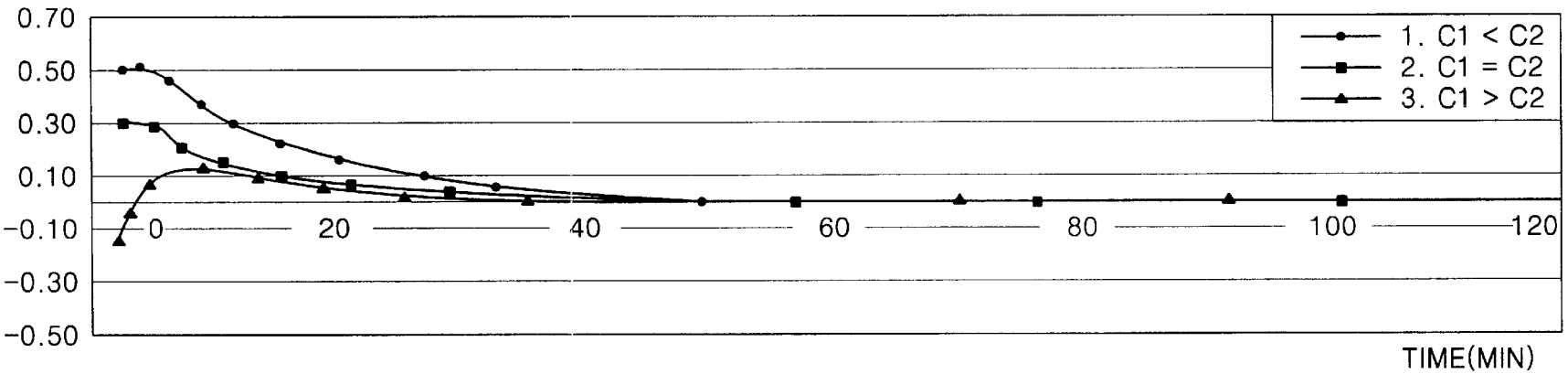
FIGS. 2 through 7 are graphs indicating the amount of drift of the electron beam according to thermal expansion of each electrode forming the electron gun.

As shown in FIG. 2, the drift phenomenon of an electron beam disappears and is stabilized in the case in which the thermal expansion coefficient C1 of the control electrode G1 is greater than the thermal expansion coefficient C2 of the screen electrode G2 (C1>C2), prior to the case in which C1=C2 or C1<C2.

Figure 3:
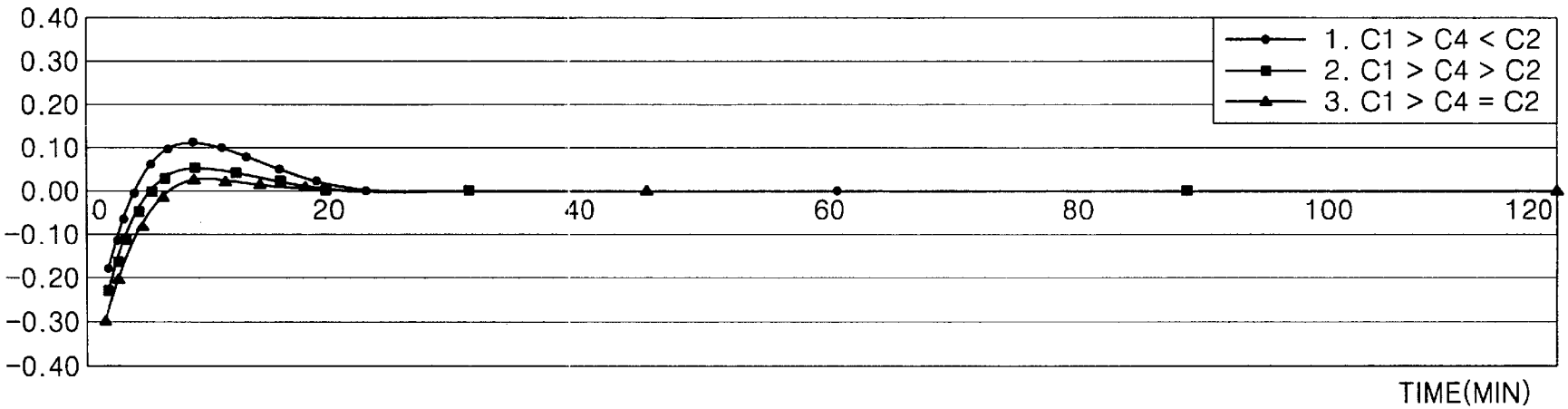

Also, as shown in FIG. 3, the phenomenon of drift of an electron beam disappears and is stabilized in the case in which the thermal expansion coefficient C1 of the control electrode G1 is greater than the thermal expansion coefficient C2 of the screen electrode G2 (C1>C2), prior to the case in which C1>C4<C2.Here, C4 is the thermal expansion coefficient of the second focus electrode G4.

Figure 4:
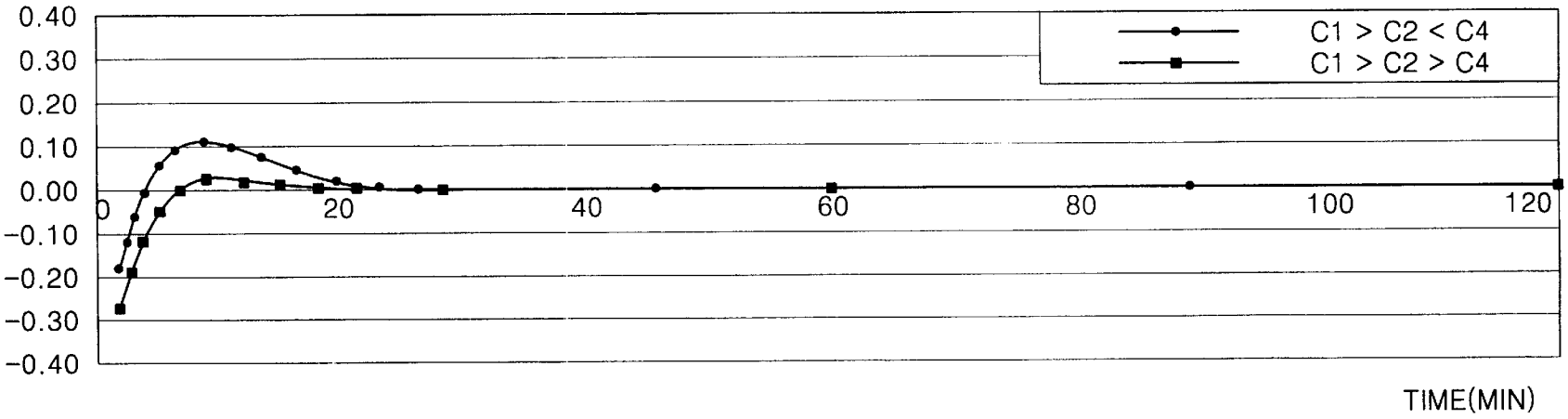

Referring to FIG. 4 showing another experiment, in the case in which the thermal expansion coefficient C2 of the screen electrode G2 is less than the thermal expansion coefficient C1 of the control electrode G1 and simultaneously greater than the thermal expansion coefficient C4 of the second focus electrode G4 (C1>C2>C4), it can be seen that the amount of drift of the initial electron beam is less than the case in which C1>C2<C4.

Figure 5:
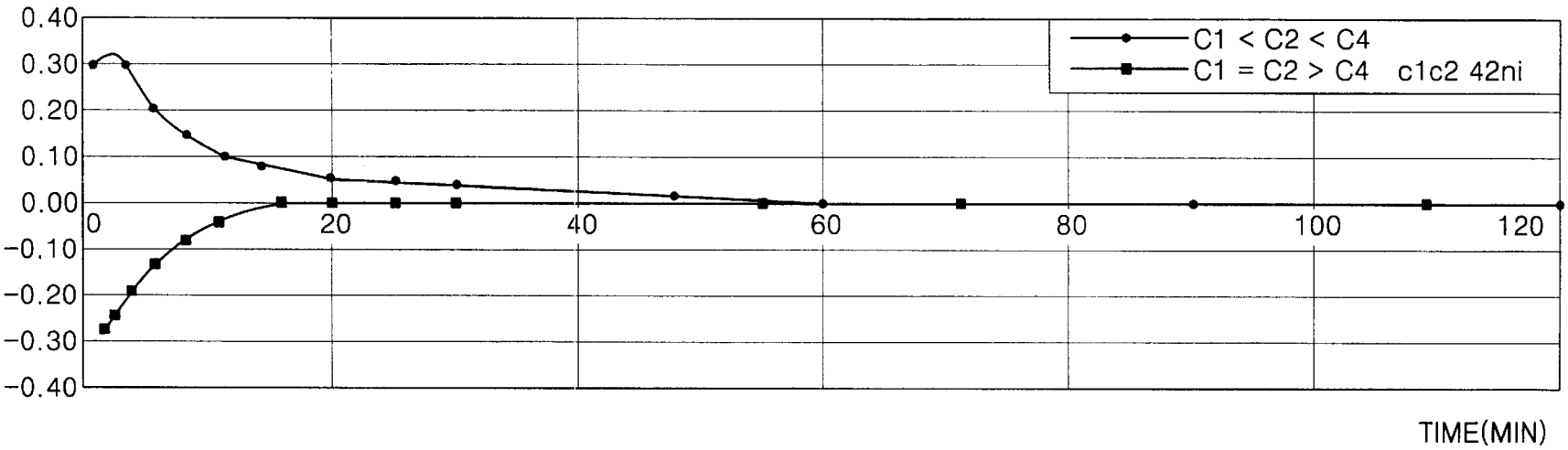

As shown in FIG. 5 showing yet another experiment, in the case in which the thermal expansion coefficients C1 and C2 of the control electrode G1 and the screen electrode G2 are the same and simultaneously the thermal expansion coefficient C4 of the second focus electrode G4 is less than the thermal expansion coefficient C2 of the screen electrode G2 (C1=C2>C4), it can be seen that the amount of drift of the electron beam due to the initial thermal expansion is 0.15 mm less than the thermal expansion coefficient in the case in which C1<C2<C4.

Figure 6:
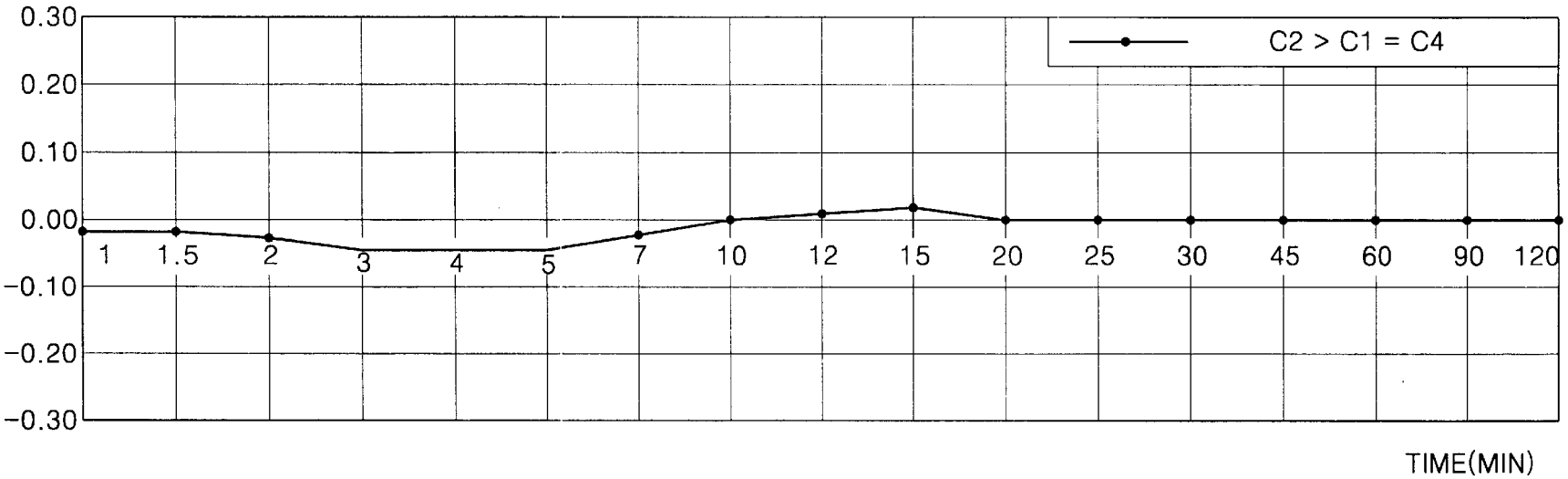

Referring to FIG. 6, it can be seen that the amount of drift is stable within ±0.5 mm in the case in which the thermal expansion coefficient C1 of the control electrode G1 is less than the thermal expansion coefficient C2 of the screen electrode G2 and simultaneously equal to that C4 of the second focus electrode G4 (C2>C1=C4).

Figure 7:
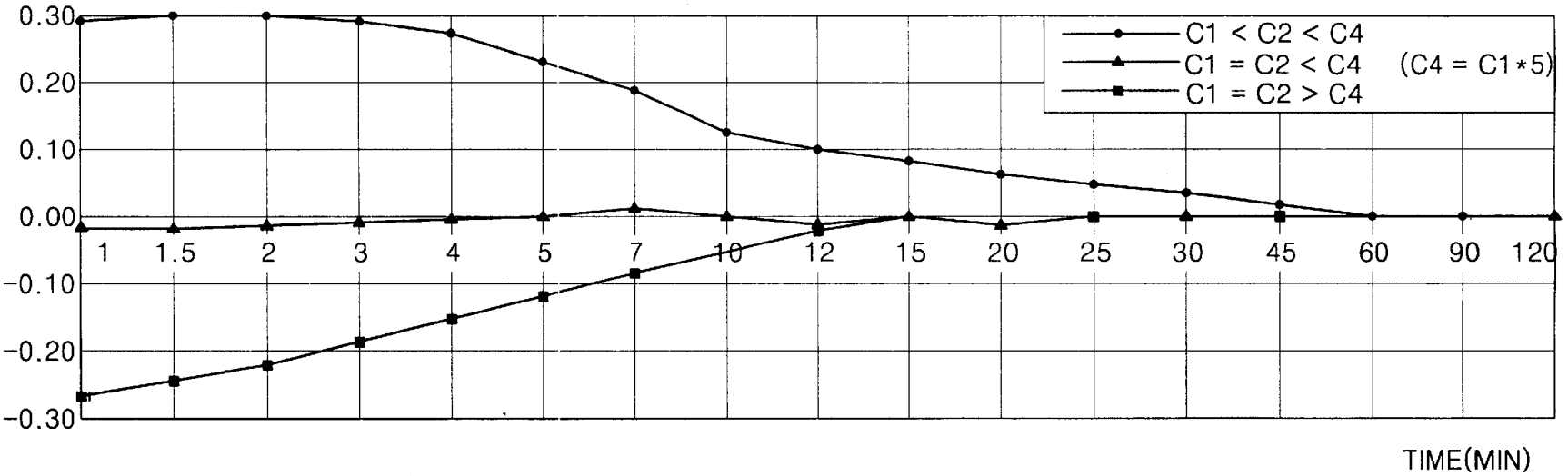

FIG. 7 showing still yet another experiment indicates the result of measurement of the initial drift amount of the electron beam with respect to the cases in which the thermal expansion coefficient C4 of the second focus electrode G4 is greater than the thermal expansion coefficient C2 of the screen electrode G2 and less than the thermal expansion coefficient C2 of the screen electrode G2, in the electron gun in which the thermal expansion coefficients C1 and C2 of the control electrode G1 and the screen electrode G2 are the same (C1=C2).

As shown in the graph, when C1=C2<C4,it can be seen that the amount of drift of electron beam is within ±0.3 mm.

As described above, in the electron gun for a color cathode ray tube according to the present invention, as the electrodes are made of materials having different thermal expansion coefficients, the amount of drift of electron beam generated after the initial driving of the cathode ray tube until a thermal balanced state is achieved can be reduced. Furthermore, a feature of convergence can be improved.

What is claimed is:

1. An electron gun for a color cathode ray tube, said electron gun comprising a cathode, a control electrode, a screen electrode and first and second focus electrodes installed in that order in a longitudinal direction of said electron gun;

said cathode, control electrode and screen electrode forming a triode; and said first and second focus electrodes forming an electron lens, wherein a thermal expansion coefficient (C4) of said second focus electrode is less than a thermal expansion coefficient of said control electrode (C1) and simultaneously greater than a thermal expansion coefficient (C2) of said screen electrode.

2. An electron gun for a color cathode ray tube, said electron gun comprising a cathode, a control electrode, a screen electrode and first and second focus electrodes installed in that order in a longitudinal direction of said electron gun;

said cathode, control electrode and screen electrode forming a triode; and said first and second focus electrodes forming an electron lens, wherein a thermal expansion coefficient (C2) of said screen electrode is equal to or less than a thermal expansion coefficient (C1) of said control electrode and simultaneously greater than a thermal expansion coefficient (C4) of said second focus electrode.

3. An electron gun for a color cathode ray tube, said electron gun comprising a cathode, a control electrode, a screen electrode and first and second focus electrodes installed in that order in a longitudinal direction of said electron gun;

said cathode, control electrode and screen electrode forming a triode; and said first and second focus electrodes forming an electron lens, wherein a thermal expansion coefficient (C4) of said focus electrode is equal to a thermal expansion coefficient (C1) of said control electrode and simultaneously greater than a thermal expansion coefficient of said screen electrode (C2).

* * * * *